US005730340A

United States Patent [19]

Bosic

[11] Patent Number: 5,730,340

[45] Date of Patent: Mar. 24, 1998

[54] FANNY PACK WITH CHILD'S TOY RETAINING ASSEMBLY

[76] Inventor: Robert D. Bosic, 3696 Beatty Dr., Riverside, Calif. 92506

[21] Appl. No.: 596,035

[22] Filed: Feb. 6, 1996

[51] Int. Cl.[6] ..... A45F 3/14

[52] U.S. Cl. ..... 224/250; 224/664; 224/684; 224/580; 224/255; 446/227

[58] Field of Search ..... 224/103, 580, 224/162, 184, 191, 651, 220, 221, 660, 676, 680, 240, 250, 254, 255, 249, 908, 909, 675, 681, 684, 664; 190/102; D3/215, 224, 226; 446/227

[56] References Cited

U.S. PATENT DOCUMENTS

| | | | |
|---|---|---|---|
| 1,119,852 | 12/1914 | McVay | 224/220 |
| 1,600,027 | 9/1926 | Welsand | 224/904 |
| 3,085,610 | 4/1963 | Vardan | 446/227 |
| 4,667,624 | 5/1987 | Smith | 224/184 |
| 4,796,790 | 1/1989 | Hamilton | 224/675 |
| 4,877,167 | 10/1989 | McNemar | 224/680 |
| 4,940,255 | 7/1990 | Donine | 224/476 |
| 5,292,042 | 3/1994 | Yamaguchi et al. . | |
| 5,465,888 | 11/1995 | Owens | 224/680 |
| 5,497,818 | 3/1996 | Marcarelli | 224/675 |

*Primary Examiner*—Renee S. Luebke
*Assistant Examiner*—Gregory M. Vidovich
*Attorney, Agent, or Firm*—Lawrence S. Cohen

[57] ABSTRACT

A carrying body preferably of a size to be worn by a child and preferably in the form of a fanny pack, having an anchor strap attached inside the carrying body providing an access length and a retaining strap which can be looped around the access length at one end and holding a child's amusement device at the other end. The retaining strap and amusement device can be stored inside the carrying body and can be accessed when it is desired to play with the amusement device. Therefore, the amusement device can be stored, and not lost when not in actual use.

6 Claims, 1 Drawing Sheet

FANNY PACK WITH CHILD'S TOY RETAINING ASSEMBLY

BACKGROUND OF THE INVENTION

The invention relates to carrying devices, in particular a carrying pack for use by a child to hold and retain against loss, an amusement device.

The problem of a child loosing amusement devices is well known. The present invention solves that problem and also provides for storage and access by the child (or parent) and provides beneficial training respecting "putting away" and promotes independence training by giving unaided access.

Relevant devices are shown in U.S. Pat. Nos. 3,085,610; 3,978,610; 4,540,219; 4,594,072; 4,722,713; 4,985,968; 4,990,157; 5,209,385; 5,275,318; 5,289,960; 5,396,683; Des. 358,252; Des. 334,471.

SUMMARY OF THE INVENTION

A personal holder and retainer assembly for storing, providing easy access and preventing loss of an amusement device. A storage body such as a fanny pack has means for attaching to a user's body. Inside the body is an elongated anchor member such as a strap fixed at each of two ends providing an access length therebetween. A retaining strap has a loop at one end for attaching to the access length and a loop at the other end for holding an amusement device. Either or both loops can be openable and of selectable size. The retaining strap and attached amusement device is stored in the body until desired. Then it can be accessed either by opening the body cover, or displacing the cover enough to withdraw it. Since the amusement device is securely attached, it is not lost when the child drops it; and it can be stored.

BRIEF DESCRIPTION OF DRAWINGS

FIG. 3 is a side view with a portion broken away to show the interior of the

DETAILED DESCRIPTION

Figure 1:
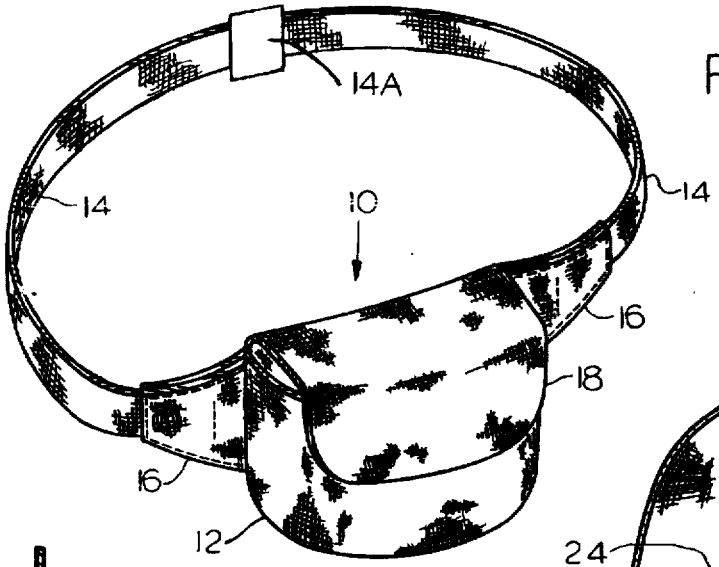
FIG. 1 is a partial perspective view showing a fanny pack of the present invention in closed configuration.
Figure 2:
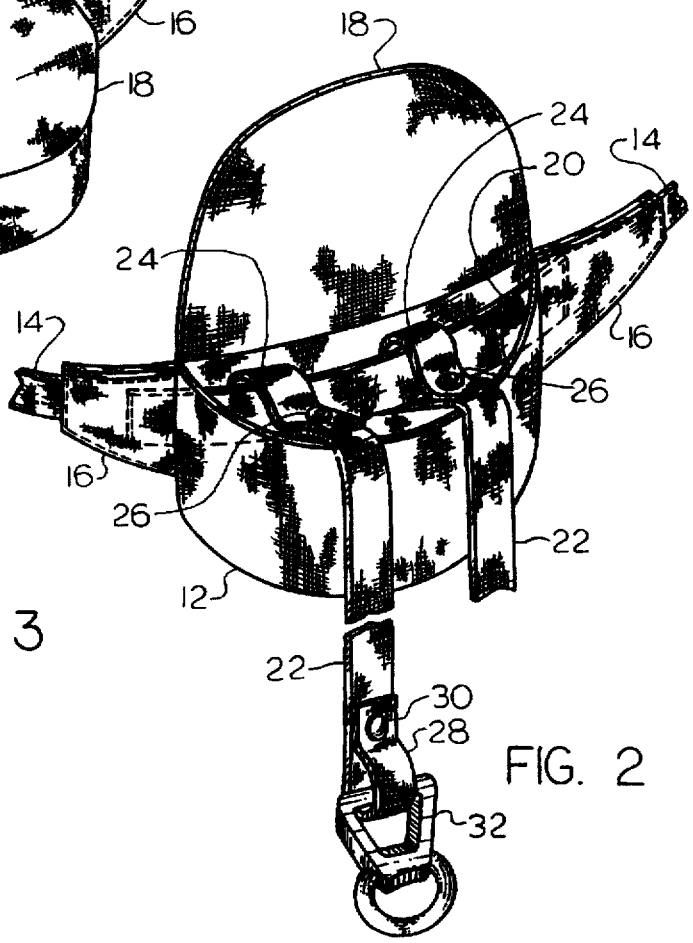
FIG. 2. is a partial perspective view showing a fanny pack and retaining assembly of the present invention.

Referring to FIG. 1, there is shown a fanny pack 10 including a body 12, a waist strap 14 having fastener elements 14*a*, connecting gussets 16 on each side of the body 12 to which each end of the carrying strap 14 is attached and a cover 18. As shown in FIG. 1, the assembly is in a normal closed configuration. Referring to FIG. 2, an interior anchor strap 20 extends across the interior of body 12; the anchor strap 20 being attached at each of its ends to one of the gussets 16.

Figure 3:
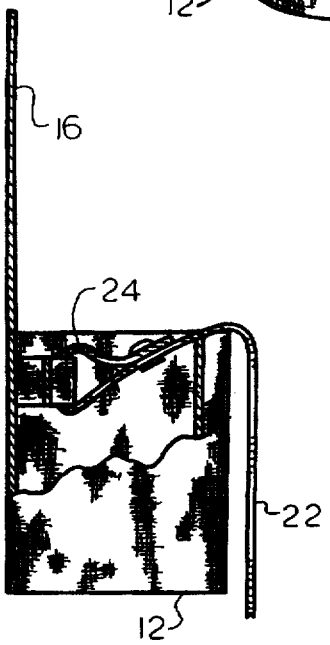
Figure 4:
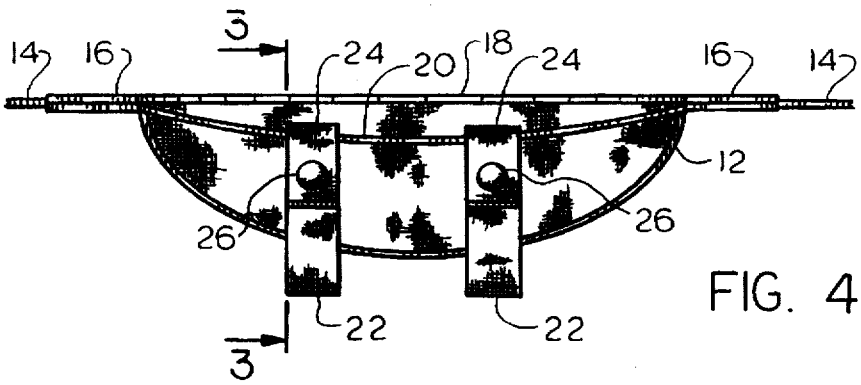
FIG. 4 is a top view of the fanny pack and retaining assembly of the present invention with the fanny pack open so as to show the interior.

Referring to FIGS. 2, 3, and 4, the invention further comprises one or more retaining straps 22. The retaining straps have a first loop portion 24 at a first end which loops around the interior anchor strap 20 and could be closed by snap fasteners 26, or by any other fastener means such as hook and loop fasteners, a buckle or button. The loops may be formed to be loose on the interior anchor strap 20 or tight, as desired. Also, the snap fasteners may have more than one position in order to elect a looser or tighter fit. At a second end of the straps 22 is a second loop 28 (shown in FIG. 2). Loop 28 is similar and may be identical to the loop 24, also being equipped with a snap fastener 30 or other fastener type. Similarly, the snap fastener 30 may have more than one position to provide a smaller or larger loop 28. Carried on loop 28 is an exemplary child's toy 32. The nature and configuration of a child's toy 32 is at the election of the user (in particular, the parent in consultation with the infant as is appreciated by parents).

As can be seen the interior anchor strap 20 is retained loosely inside the fanny pack body 12 by being sewed at each end to the gussets 14. It can be made adjustable in length. It provides an access length between its two ends on which to place the loop 26 of the retaining strap 22.

The manner of assembly and construction of the assembly in many respects is at the election of the manufacturer. The essential elements are the fanny pack or similar bag, providing a body 12 having an interior space, an interior anchor strap 20 being fixed inside the interior space, preferably loosely for easy access and retaining straps 22 which have a first end forming a loop 24 around the interior anchor strap 20 and a second end forming a loop 28 around a toy or other implement 32 to be retained.

In use the fanny pack is fitted around the waist of the child. In the stored position, the retaining assembly including the toy is packed inside the fanny pack body and the cover closed as seen in FIG. 1. Although not shown, the cover can have a closure retaining element such as a hook and loop fastener or other common fastener to hold it in closed position. Either with the cover still closed or with the cover open, one or more of the retaining assemblies may be withdrawn for use. That is, the retaining strap is pulled out of the body so that the toy or implement 32 is available for handling by the child. As shown in FIG. 2, access is available by opening the cover 20. But as noted for example, if a single closure element is applied it would be possible to remove the retaining strap and the implement 32 without opening the cover. Thus, in use, the fanny pack and retaining assembly allows a child to carry around a selected amusement implement which will not be lost and in fact can be stored away in a convenient location for access independently by the infant if desired it also permits the infant to be taught responsibility of storing his amusement implements and obtaining them independently. In addition to responsibility, it also allows for independence training by permitting the infant to obtain for use and to put away his own implements without assistance from a parent.

Although particular embodiments of the invention have been described and illustrated herein, it is recognized that modifications and variations may readily occur to those skilled in the art, and consequently it is intended that the claims be interpreted to cover such modifications and equivalents.

What is claimed is:

1. A personal holder and retainer assembly comprising:

a storage body having an interior space;

means for retaining the storage body on a person;

an interior anchor element fixed within the interior space of the storage body having a first end and a second end and a length between the first end and the second end and each of the first end and the second end being attached to the storage body, while permitting access to said length; and, at least one retaining strap having a loop at a first end and an openable loop at a second end, the loop at the first end being looped around the length of the interior anchor element; and wherein the interior anchor element is a strap sewn to the interior space of the storage body at each of its ends.

2. The personal holder and retainer assembly of claim 1 wherein the loop at the first end of the retaining strap is openable.

3. The personal holder and retainer assembly of claim 1 further comprising an amusement device held by the loop at the second end of the retaining strap.

4. The personal holder and retainer assembly of claim 1 wherein the storage body is a fanny pack.

5. The personal holder and retainer assembly of claim 1 wherein the at least one retaining strap has openable loops at each of said first end and said second end.

6. The personal holder and retainer assembly of claim 5 wherein said means for retaining the storage body on a person is a combination of straps and fastener elements.

* * * * *